United States Patent [19]

Yamashita

[11] Patent Number: 4,558,294

[45] Date of Patent: Dec. 10, 1985

[54] MAGNET ROLL AND METHOD OF PRODUCING THE SAME

[75] Inventor: Keitaro Yamashita, Kansato, Japan

[73] Assignee: Hitachi Metals, Ltd., Japan

[21] Appl. No.: 601,372

[22] Filed: Apr. 17, 1984

[30] Foreign Application Priority Data

Apr. 18, 1983 [JP] Japan ..... 58-56795[U]

[51] Int. Cl.[4] ..... H01F 7/02

[52] U.S. Cl. ..... 335/303; 118/657; 355/3 DD

[58] Field of Search ..... 335/303, 306; 118/657, 118/658; 355/3 DD

[56] References Cited

U.S. PATENT DOCUMENTS 3,721,189 3/1973 Bray ..... 335/306 X
4,022,157 5/1977 Rasekhi et al. ..... 118/658
4,040,387 8/1977 Washio et al. ..... 118/658
4,439,034 3/1984 Daniels ..... 118/658

FOREIGN PATENT DOCUMENTS 961725 6/1964 United Kingdom ..... 335/303

*Primary Examiner*—George Harris
*Attorney, Agent, or Firm*—Finnegan, Henderson Farabow, Garrett & Dunner

[57] ABSTRACT

A magnet roll comprising a shaft having a polygonal cross section and a plurality of magnet blocks bonded to the shaft and to each other. At least one of the magnet blocks has mating means contacted with the corresponding mating means of the shaft, and an adjacent pair of the magnet blocks are bonded to each other in a positional relationship determined by mating means provided on the contacting surfaces of the adjacent blocks and by contact with the shaft surface. This magnet roll can be assembled very precisely without difficulty.

8 Claims, 3 Drawing Figures

MAGNET ROLL AND METHOD OF PRODUCING THE SAME

BACKGROUND OF THE INVENTION (1) Field of the Invention

The present invention relates to a magnet roll, more specifically a magnet roll comprising bonded magnet blocks and a shaft of a polygonal cross section. It also relates to a method of producing such a magnet roll.

(2) Description of the Prior Art

A magnet roll device comprising a permanent magnet roll having a plurality of magnet poles and a cylindrical nonmagnetic sleeve surrounding the magnet roll in a rotatable relationship to each other is used for conveying powdery developers in magnetic brush developing, magnetic brush cleaning, etc.

Magnet rolls of various structures have been proposed, and some of them comprise permanent magnet blocks instead of integral, cylindrical magnets. Permanent magnet blocks are advantageous over integral, cylindrical magnets in that the former can provide a magnet roll with a lot of magnet poles more easily than the latter. Further, permanent magnet blocks made of magnet powder and plastics are advantageous over sintered blocks in that the former has somewhat flexibility which is needed for assembling and bonding the blocks which inevitably have dimensional irregularities such as warps.

Various magnet rolls comprising anisotropic bonded magnet blocks secured onto a shaft have been disclosed. See U.S. Pat. No. 3,455,276. This patent discloses a magnet roll comprising a plurality of fan-shaped magnet blocks bonded to a central, round shaft and also to each other. These magnet blocks, however, are not provided with any means for ensuring the precise positioning thereof. Also, since the magnet blocks have the same shape, complicated magnet pole arrangements cannot be attained.

Thus, although magnetic blocks are very convenient to provide a magnet roll with lots of magnet poles which may be different from each other in strength and direction of magnetization, they encounter difficulties in being precisely positioned onto a shaft.

SUMMARY OF THE INVENTION

An object of the present invention is to provide a magnet roll comprising a shaft of a polygonal cross section and a plurality of magnet blocks which are provided with means for ensuring the precise positioning thereof relative to the shaft.

Another object of the present invention is to provide a method of producing such a magnet roll.

A shaft used according to the present invention should have a polygonal cross section. The term "polygonal" used herein means that the cross section is formed with a plurality of rectilinear sides, including triangular and rectangular cross sections and more. The rectangular cross section, particularly square cross section is most preferred for practical reasons.

At least one of the magnet blocks has a means adapted to be mated with the corresponding means of a shaft of a polygonal cross section. The above means of the magnet block may be an angled portion in the shaft-contacting surface thereof formed by two flat surfaces of different directions, and the corresponding mating means of the shaft may be a corner thereof. When the shaft is rectangular in cross section, the mating means of the magnet block may be an angle formed by two flat surfaces perpendicular to each other formed in the shaft-contacting surface.

This block having such a mating means is the first member to be assembled onto the shaft because its precise positioning both radial and circumferential, is easily achieved by placing the angle of the magnet block on the corner of the rectangular shaft.

A surface of this block, which is to be in contact with an adjacent magnet block, may have a means for mating with corresponding mating means of the adjacent magnet block. Such complementary mating means on the contacting surfaces of adjacent magnet blocks may be in any form as long as they ensure the precise circumferential and radial positioning of the adjacent blocks. They are preferably complementary angled portions of the respective contacting surfaces such as a pair of angles each formed by two flat surfaces, in a mating relationship, and complementary grooves and ridges.

Each of the remaining magnet blocks has a surface to be contacted with the shaft surface and surfaces to be contacted with respective adjacent blocks. The shaft-contacting surface of another magnet block may have an angled portion to be mated with another corner of the shaft to enhance the precise positioning of the magnet blocks on the shaft. Each surface of this other magnet block should have a suitable portion for mating with the corresponding portion of an adjacent block.

The last magnet block to be assembled onto the shaft may not have any complementary mating means, because what is necessary is only to insert it into the open space remaining in the magnet roll being assembled.

Thus, for example, the assembling of magnetic blocks with a rectangular shaft is carried out simply by fitting the mating means of the magnet blocks and shaft to each other and bonding them. The precise positioning of magnetic blocks can be easily achieved by first mating by sequentially engaging the complementary mating means of adjacent blocks with one corner of the rectangular shaft, and continuously assembling the remaining blocks onto the shaft the block having a right angle portion in the shaft-contacting surface.

The magnet blocks may be in various shapes, having magnetic poles of various strength and magnetization direction. The magnet blocks preferably have outer surfaces which form a cylindrical surface when assembled. However, they may form a different cross section when assembled, depending on the intended application.

The magnet blocks may be made of various materials, but plastic magnets are most preferable because they can be easily formed into various shapes and have flexibility which enables them to absorb their possible curves in the longitudinal direction. Plastic magnet blocks may be manufactured by any conventional method; a preferred method is to perform an injection molding of a molten mixture of magnet powder and plastics such as ethylene-vinyl acetate copolymers and polyamides in a suitable mold equipped with magnets for effecting anisotropic magnetization treatment of the magnet blocks.

DESCRIPTION OF THE PREFERRED EMBODIMENTS

Figure 1:
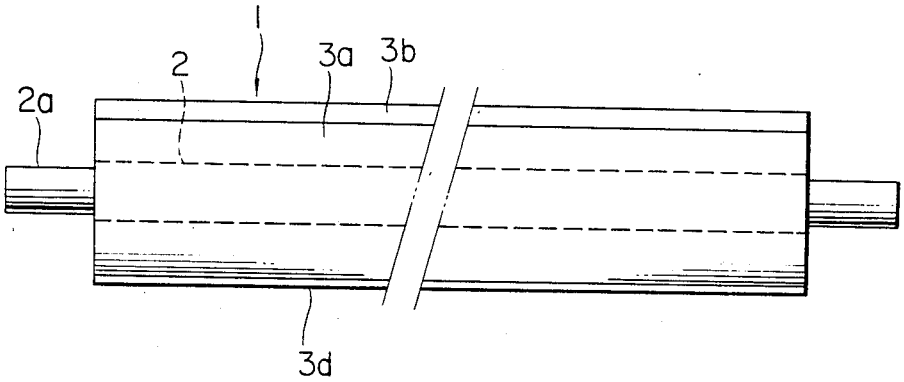
FIG. 1 is a plan view of a magnet roll according to an embodiment of the present invention.
Figure 2:
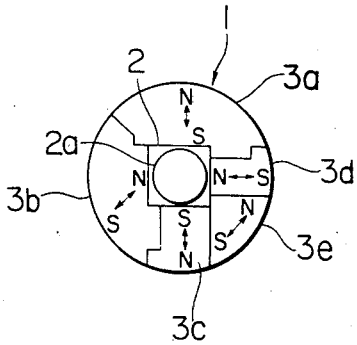
FIG. 2 is a side view of the magnet roll of FIG. 1.

Referring to FIG. 1, a magnet roll 1 comprises a shaft 2 having a square cross section with cylindrical projections 2*a* at both ends, and magnet blocks 3*a*–3*e*. The arrangement and structures of the magnet blocks 3*a*–3*e* as well as their directions of magnetization are shown in FIG. 2. Please note that each magnet block has a different cross section with different direction of magnetization.

Figure 3:
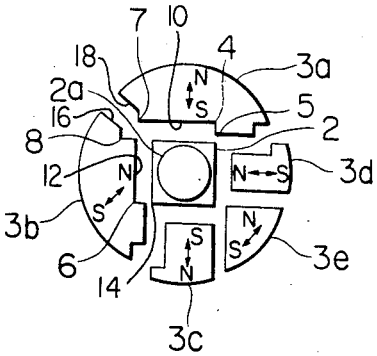
FIG. 3 is an exploded view of the magnet roll of FIG. 2.

FIG. 3 shows the shaft 2 and the magnet blocks 3*a*–3*e* separated from each other. It is noted that the magnet block 3*a* has an angled portion 4 formed in the shaft contacting surface 10 which can mate with a corner 5 of the shaft 2. The magnet block 3*a*, therefore, may be first bonded to the square shaft 2 while mating the angle 4 with the corner 5. In this embodiment, the magnet block 3*b* also has a right angled portion 6 in shaft contacting surface 12, so it is second to be bonded onto the shaft 2. The magnet block 3*b* may be easily positioned precisely on the shaft 2 and the block 3*a* by mating the angle 6 with corner 14 of the shaft 2, and by engaging complementary mating means on the contacting surfaces of blocks 3*a* and 3*b*, namely groove 8 in surface 16 of the block 3*b* with a ridge 7 in surface 18 of the block 3*a*. The magnet blocks 3*c* and 3*d* are then bonded to the shaft 2 and adjacent blocks 3*b* and 3*a*. The sector-shaped magnet block 3*e* is finally inserted into an open space of the magnet roll being assembled. Accordingly, the magnet block 3*e* need not have any projection, groove or angle. The resulting magnet roll 1 has six magnet poles as shown in FIG. 2.

EXAMPLE

Barium ferrite powder (particle size: about 1 μm) and nylon 66 were blended in the ratio by weight of 8:2 in a batch-type kneader at about 240° C., and then subjected to injection molding at 270° C. and 70 kg/cm in a suitable magnetic field. The moldings are cooled and magnetized to provide the anisotropic magnet blocks 3*a*–3*e* as shown in FIG. 3. The assembling of the anisotropic magnet blocks 3*a*–3*e* were conducted in the order of 3*a*–3*b*–3*c*–3*d*–3*e* while contacting the corresponding complementary mating portions of the blocks and the shaft with each other as mentioned above. The resulting magnet roll has an outer diameter of 15 mm. The assembling and bonding of all the magnet blocks 3*a*–3*e* took about 4 minutes, much shorter than the time (about 7 minutes) which was usually needed for bonding magnetic blocks of the same size having no complementary mating portions. This is attributable to the fact that the precise positioning of the magnetic blocks can be conducted very easily according to the present invention. This is particularly advantageous when a small-sized magnet roll is to be made.

I claim:

1. A cylindrical magnet roll of the type having a plurality of magnet blocks each formed from magnet powder bonded in plastic, the roll comprising a shaft having a polygonal cross section, the plurality of magnet blocks being bonded to said shaft and abuttingly contacting, and being bonded to, each other, at least one of said magnet blocks having mating means which is in contact with corresponding mating means of said shaft, said mating means providing a predetermined circumferential and radial positioning of said one magnet block with respect to said shaft, the roll further comprising complementary mating means formed at least on the respective contacting surfaces of said one magnet block and the magnetic blocks immediately adjacent thereto, said adjacent magnet blocks being positioned relative to said shaft and to each other in a predetermined relationship by said complementary mating means and by contact with the surface of said shaft.

2. The magnet roll according to claim 1, wherein said shaft has a square cross section, and said one block has a shaft-contacting surface with a right angle formed in the surface for contact with a corner of said square shaft.

3. The magnet roll according to claim 1 wherein said complementary mating means includes the respective contacting surfaces of said one and said adjacent magnet blocks being configured to mate with each other in a ridge-groove relationship.

4. A method of producing a cylindrical magnet roll of the type comprising a shaft of a polygonal cross section and a plurality of magnet blocks surrounding the shaft, each of said magnet blocks being formed from magnetic powder bonded in plastic, the method comprising the steps of:

bonding a first magnet block having a mating means to said shaft having corresponding mating means, said mating means and said corresponding mating means being in contact with each other to position said first block circumferentially and radially with respect to said shaft;

bonding a second magnet block to both said first magnet block and said shaft, said second magnet bonding step including the substep of engaging complementary mating means previously formed in the contacting surfaces of said second magnet block and said first magnet block to provide positioning of said second magnetic block relative to said first block; and conducting the bonding of the remaining magnet blocks to said shaft and to a respective adjacent magnet block already bonded to the shaft, until the last magnet block is bonded.

5. The magnet roll according to claim 2 wherein said complementary mating means includes the respective contacting surfaces of said one and said adjacent magnet blocks being configured to mate with each other in a ridge-groove relationship.

6. The magnet roll as in claim 1 wherein complementary mating means are formed on respective contacting surfaces of all of said plurality of magnet blocks except the contacting surfaces of the last-to-be-installed block and those contacting surfaces of the two magnet blocks disposed to contact said last block.

7. The magnet roll as in claim 6 wherein said last block is formed in the shape of a sector of a circle.

8. The magnet roll as in claim 1 wherein a second magnet block has second mating means in contact with second corresponding mating means on said shaft.

* * * * *